US005723071A

United States Patent [19]

Bartch et al.

[11] Patent Number: 5,723,071

[45] Date of Patent: Mar. 3, 1998

[54] BAKE-HARDENABLE SOLUTION FOR FORMING A CONDUCTIVE COATING

[75] Inventors: Donald Walter Bartch, York; James Francis Edwards, Lancaster, both of Pa.

[73] Assignee: Thomson Consumer Electronics, Inc., Indianapolis, Ind.

[21] Appl. No.: 715,727

[22] Filed: Sep. 19, 1996

[51] Int. Cl.[6] ..... H01B 1/18; H01B 1/24

[52] U.S. Cl. ..... 252/510; 252/511; 106/122; 106/203.1; 106/204.1

[58] Field of Search ..... 252/510, 511; 106/122, 203.1, 204.1

[56] References Cited

U.S. PATENT DOCUMENTS 4,289,800 9/1981 Shah ..... 427/68
4,463,075 7/1984 Fritsch et al. ..... 430/23
4,474,685 10/1984 Annis ..... 252/503
4,917,822 4/1990 Thiel et al. ..... 252/511
5,156,770 10/1992 Wetzel et al. ..... 252/510

*Primary Examiner*—Paul Lieberman
*Assistant Examiner*—Mark Kopec
*Attorney, Agent, or Firm*—Joseph S. Tripoli; Dennis H. Irlbeck; Vincent J. Coughlin, Jr.

[57] ABSTRACT

The present invention relates to a bake-hardenable solution that is electrically conductive, when hardened. The resultant conductive panel coating 38 is utilized for electrically interconnecting a metal stud 27 embedded in a sidewall 20 of a faceplate panel 12 of a CRT 10 to a conductive layer 24 overlying a luminescent screen 22 on an interior viewing surface of said faceplate panel 12. The solution consists essentially of the following ingredients: glass frit powder; graphite; organic binder; solvent; and a material to enhance the porosity of the resultant conductive panel coating 38.

15 Claims, 2 Drawing Sheets

BAKE-HARDENABLE SOLUTION FOR FORMING A CONDUCTIVE COATING

The invention relates to a bake-hardenable solution that, when hardened, forms a conductive panel coating that interconnects at least one metal stud, embedded in a sidewall of a faceplate panel of a cathode-ray tube (CRT), to an aluminum screen layer and, more particularly, to a solution that, when hardened, forms a conductive panel coating that does not generate particles, has a conductivity of less than 1000 ohms/inch (Ω/in), and is removable, by water washing, if necessary to salvage the faceplate panel, before the screen layer is baked.

BACKGROUND OF THE INVENTION

U.S. Pat. No. 4,289,800, issued to Shah on Sep. 15, 1981, describes a method of providing an electrically conductive bridge between the shadow mask, operating at high voltage, and the aluminum layer overlying the phosphor screen of a CRT. In the patented process, a filming lacquer is provided between the relatively rough phosphor screen and the aluminum layer. The filming lacquer provides a smooth surface on which the aluminum is be deposited so that the aluminum layer is mirror-like and increases the brightness of the display by reflecting more light through the viewing faceplate. However, the lacquer also extends to the metallic suspension members, or studs, extending from the sidewall of the facplate panel. The solution which forms the conductive bridge is formulated to contain butyl cellosolve which penetrate the lacquer on the studs and, when baked, permits the solution to establish a positive electrical contact, or conductive bridge, between the aluminum layer and the studs. A drawback of such a method is that the residual lacquer on the studs provides sites for the generation of particles within the tube, due to movement of the shadow mask during tube operation.

U.S. Pat. No. 4,917,822, issued to Thiel et al. on Apr. 17, 1990, describes another conductive suspension for making electrical contact between elements inside a picture tube. The conductive suspension is said to be permeable to decomposition products during bakeout without forming blisters or without any exfoliation taking place, yet is easy to remove from defective parts by conventional cleaning processes.

Because many of the conductive solutions and suspensions are applied by hand, it is difficult to control the thickness of the resultant coatings. Coatings that are said to withstand blistering or peeling, if applied at a controlled thickness, often are found to exhibit these undesirable tendencies if applied too thickly. Thus, a need exists for a bake-hardenable solution that, when hardened, forms a conductive coating that resists blistering and peeling, regardless of thickness, but prior to bakeout is readily removed by conventional cleaning processes, if it is necessary to salvage the faceplate panel because of phosphor screen or aluminizing defects.

SUMMARY OF THE INVENTION

The present invention relates to a bake-hardenable solution that is electrically conductive, when hardened. The resultant conductive panel coating is utilized for electrically interconnecting a metal stud embedded in a sidewall of a faceplate panel of a CRT to a conductive layer overlying a luminescent screen on an interior viewing surface of the faceplate panel. The solution consists essentially of the following ingredients: a glass frit powder; graphite; an organic binder; a solvent; and a material to enhance the porosity of the resultant coating.

BRIEF DESCRIPTION OF THE DRAWINGS

The invention will now be described in greater detail, with relation to the accompanying drawings, in which.

DETAILED DESCRIPTION OF THE PREFERRED EMBODIMENTS

Figure 1:
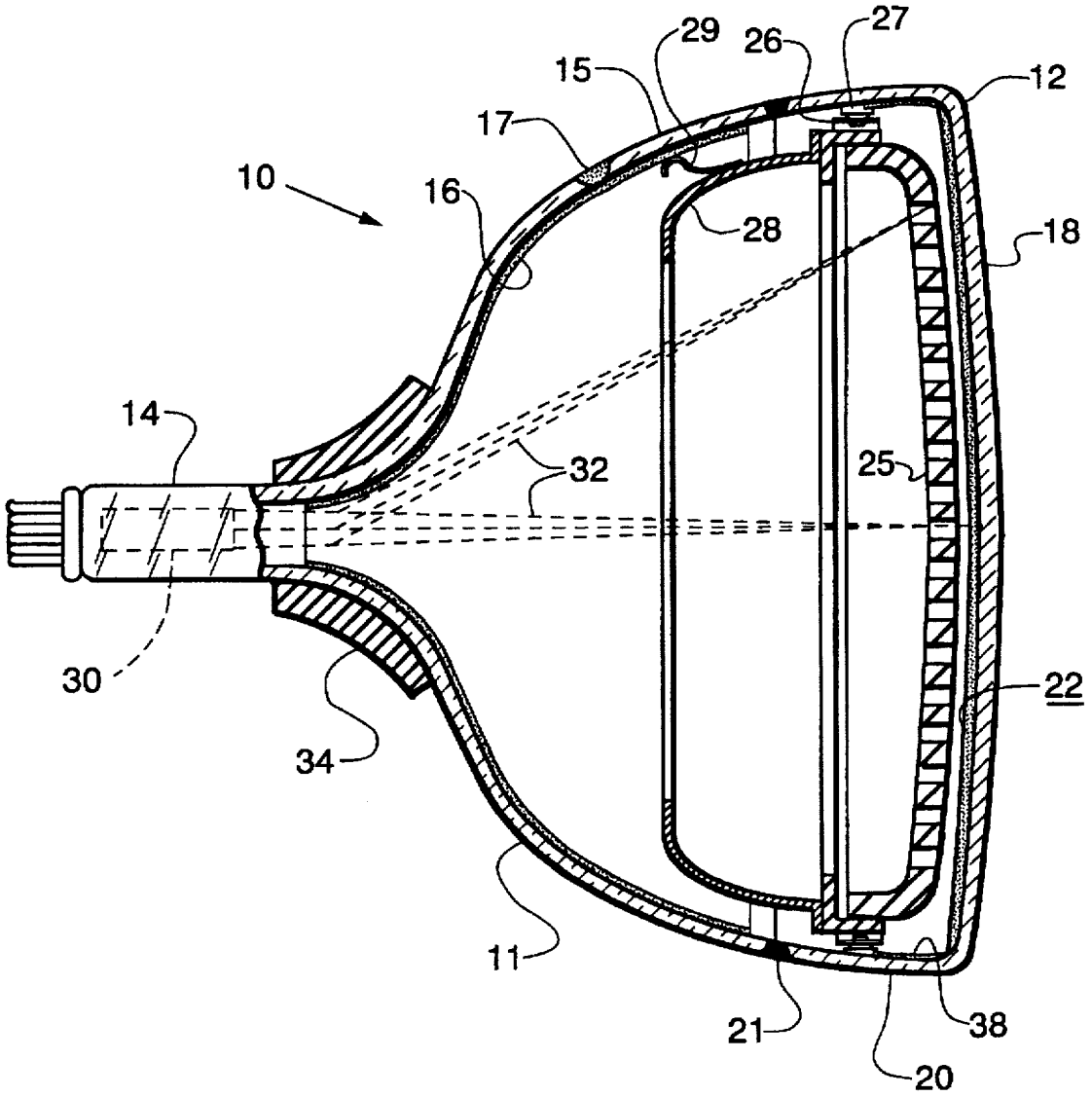
FIG. 1 is a plan view, partially in axial section, of a color CRT made according to the present invention.
Figure 2:
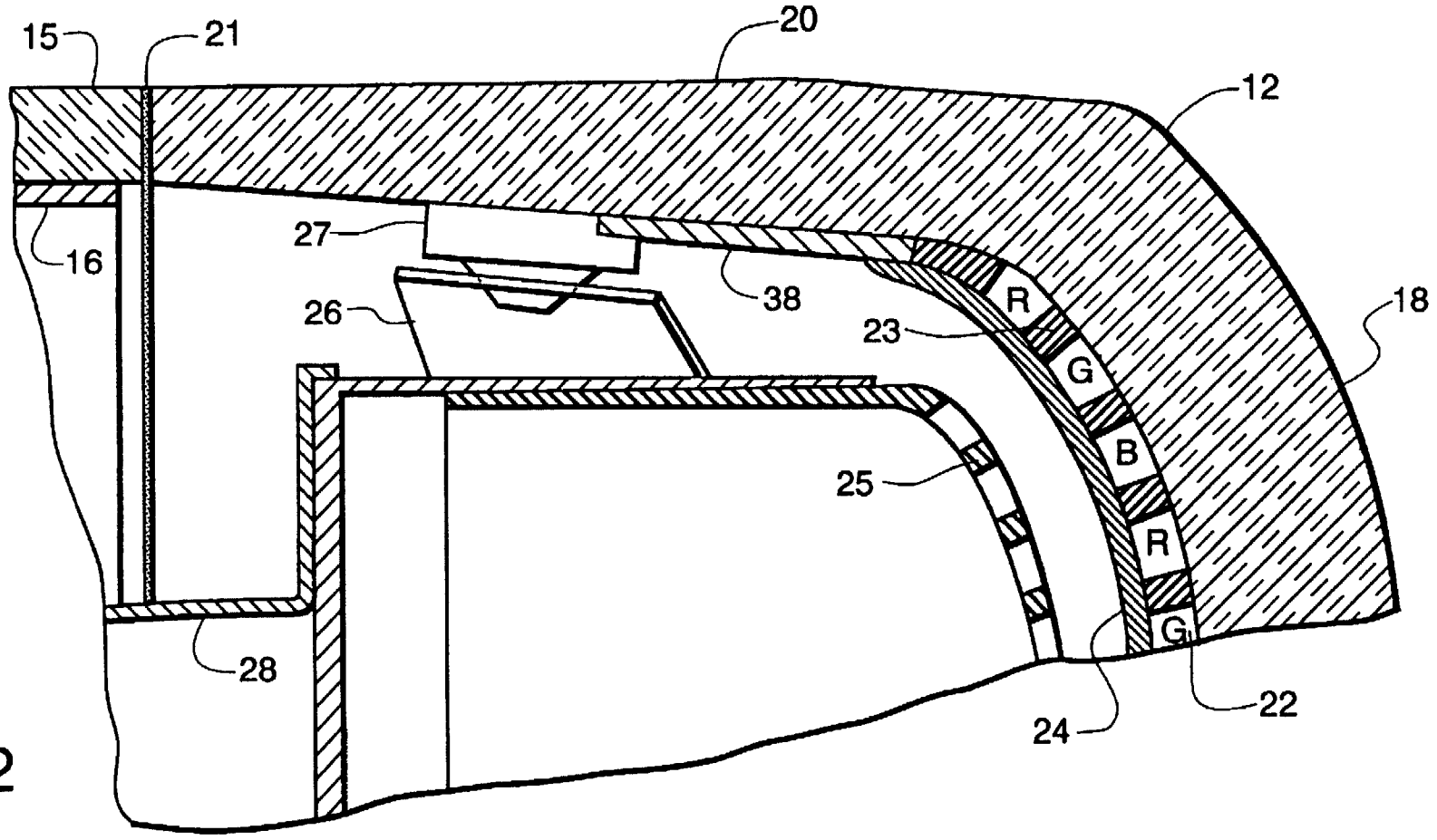
FIG. 2 is a section of the tube of FIG. 1 showing the conductive panel coating interconnecting the aluminum layer and the stud embedded in the faceplate panel sidewall.

FIGS. 1 and 2 show a cathode-ray tube 10 having a glass envelope 11 comprising a rectangular faceplate panel 12 and a tubular neck 14 connected by a rectangular funnel 15. The funnel has an internal conductive funnel coating 16 that extends along the internal surface thereof and into the neck 14. An anode button 17 provides an electrical connection from an external high voltage source (not shown) to the internal conductive funnel coating 16 on the funnel 15. The panel 12 comprises a cylindrical viewing faceplate 18 and a peripheral flange or sidewall 20 that is sealed to the funnel 15 by a glass frit 21. A three-color phosphor screen 22 is carded on the inner surface of the faceplate 18. The screen 22 is a line screen with the phosphor lines R, G and B, respectively, arranged in color groups or picture elements of three stripes, or triads, in a cyclic order. Preferably, the phosphor lines are separated from each other by a light-absorbing matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18.

A multi-apertured color selection electrode 25, such as a shadow mask, is removably mounted within the panel 12, in predetermined spaced relation to the screen 22. A plurality of metal springs 26 are attached to the shadow mask 25. Each of the springs 26 is detachably attached to one of a corresponding plurality of studs 27 which are embedded in the sidewall 20. An internal magnetic shield 28 is attached to the bottom surface of the shadow mask 25. A resilient electrical connector 29 is attached between the shield 28 and the internal conductive funnel coating 16. An electron gun 30, shown schematically by the dashed lines in FIG. 1, is centrally mounted within the neck 14 to generate and direct three inline electron beams 32, comprising a center and two side or outer beams, along convergent paths through openings in the mask 25 to the screen 22.

The CRT of FIG. 1 is designed to be used with an external magnetic deflection yoke, such as the yoke 34, located in the region of the funnel-to-neck junction. When activated, the yoke 34 subjects the three beams 32 to magnetic fields that cause the beams to scan a rectangular raster, horizontally and vertically, over the screen 22. The shield 28 protects the beams 32 passing therein from external magnetic fields that would otherwise deleteriously affect the register of the beams with the phosphor elements on the screen 22.

To ensure that electrical contact is established and maintained between the aluminum layer 24 and the shadow mask 25, which is connected to anode potential through resilient connector 29, a conductive panel coating 38 is formed between at least one of the studs 27 and the aluminum layer 24. The conductive panel coating 38 is formed by applying, for example by painting, a bake-hardenable solution, that becomes electrically conductive when hardened and has a resistance of less than 1000 Ω/in. The solution contacts only a portion of the stud 27 and does not extend onto the area of the stud to which the spring 26 is attached. By keeping the solution off of the spring contact area, the likelihood of generating coating particles from movement of the spring 26 on the stud 27 is eliminated. A solution for making the conductive panel coating 38 consists essentially of the following ingredients: glass frit powder; graphite powder; acrylic lacquer; solvent; and pecan shell flour. The solution also may include a colloidal graphite solution, such as Electrodag 41 or 154, supplied by Acheson Colloids Co., Port Huron, Mich.

The bake-hardenable solution is formed by combining the ingredients described in the following paragraph. The quantity of the solution for each of the Examples is small because very little of the solution is needed for each tube. While specific suppliers and their designations are provided, equivalent materials manufactured by other suppliers may be used.

Pour 28 grams (g) of a glass frit powder into a ball mill jar. The frit may comprise those designated as EG 4003, supplied by Ferro Corp., Cleveland, Ohio, or 8463, supplied by Corning Glass Works, Corning, N.Y. Also, a frit designated as DS 1406, available from Okuno Chemical Industries Co., Ltd., Osaka, Japan, may be used.

Add 9 grams of graphite powder 200-39 as supplied by Joseph Dixon Crucible Co., Jersey City, N.J., to the glass frit powder in the ball mill.

Stir in 12 grams of acrylic lacquer as supplied by Pierse & Stevens, Chemical Corp., Buffalo, N.Y.

Add 30 grams of xylene to the ball mill; and between 0.95 to 3.0 grams of pecan shell powder or walnut shell powder, as supplied by Composite Materials of America, Inc., Montgomery, Ala.

Ball mill the mixture for about 18 to 24 hours. The coating solution is then transferred to a suitable container for storage. The shelf life of the solution is several months.

Approximate percentage, by weight, of the ingredients compounded to the foregoing, and the preferred range in weight percent, comprise the following:

EXAMPLE 1

| INGREDIENTS | Weight (g) | Preferred (wt. %) | Range (wt. %) |
|---|---|---|---|
| glass frit powder | 28 | 34.61 | 34.15–35.02 |
| graphite | 9 | 11.13 | 10.98–11.26 |
| acrylic lacquer | 12 | 14.83 | 14.63–15.01 |
| solvent | 30 | 37.08 | 36.58–37.52 |
| porosity enhancer | 0.9–3.0 | 2.35 | 1.19–3.66 |

Adherence of the coatings was good, and the resistance ranged from 320–440 Ω/in.

The glass frit powder component comprises the binding medium for the solution. The graphite comprises the electrically conductive medium. The acrylic lacquer provides compatibility with the filming lacquer that underlies the aluminum layer and acts as a binder of the ingredients before bakeout. The xylene is an organic solvent that forms the carrier for the solid components of the solution. While xylene is preferred, toluene may be mixed with the xylene, up to a ratio of one part toluene to one part xylene. The rate of evaporation of the solvent is controlled by the toluene-xylene ratio. An increase in the amount of toluene accelerates the rate of evaporation of the solvent. The pecan shell flour is added to enhance the porosity of the coating and to improve the ability to salvage panels by removing the conductive panel coating on panels that have screening or aluminizing defects. Pecan shell flour is preferred in the present formulation; however, walnut shell flour also may be used.

While the foregoing formulation is preferred, other formulations for bake-hardenable solutions have been evaluated and are listed hereinafter.

EXAMPLE 2 (EG #10)

| INGREDIENTS | WEIGHT (g) | CONCENTRATION (wt. %) | REMARKS |
|---|---|---|---|
| frit EG 4003 | 3.5 | 41.67 | Resistance |
| graphite | 0.9 | 10.71 | 320–600 Ω/in. |
| Electrodag 154 | 1.0 | 11.90 | Some samples |
| acrylic lacquer | 1.5 | 17.86 | showed lifting |
| toluene | 1.5 | 17.86 | of the coating. |

EXAMPLE 3 (EG #10B)

| INGREDIENTS | WEIGHT (g) | CONCENTRATION (wt. %) | REMARKS |
|---|---|---|---|
| frit EG 4003 | 3.5 | 39.33 | Resistance |
| graphite | 0.9 | 10.11 | 300–400 Ω/in. |
| Electrodag 154 | 1.0 | 11.24 | Adhesion good |
| acrylic lacquer | 1.5 | 16.85 | except over very |
| toluene | 1.0 | 11.23 | thin aluminum. |
| xylene | 1.0 | 11.24 | |

EXAMPLE 4 (EG #10C)

| INGREDIENTS | WEIGHT (g) | CONCENTRATION (wt. %) | REMARKS |
|---|---|---|---|
| frit EG 4003 | 14.0 | 35.81 | Resistance |
| graphite | 3.6 | 9.21 | 230–500 Ω/in. |
| Electrodag 154 | 4.0 | 10.23 | Baked adherence |
| acrylic lacquer | 6.0 | 15.34 | not as good as |
| toluene | 4.5 | 11.51 | Examples 2 and |
| xylene | 4.5 | 11.51 | 3. |
| pecan shell flour | 2.5 | 6.39 | |

EXAMPLE 5 (EG #10D)

| INGREDIENTS | WEIGHT (g) | CONCENTRATION (wt. %) | REMARKS |
|---|---|---|---|
| frit EG 4003 | 14.0 | 37.23 | Resistance |
| graphite | 3.6 | 9.57 | 260–475 Ω/in. |
| Electrodag 154 | 4.0 | 10.64 | Adherence good |
| acrylic lacquer | 6.0 | 15.96 | on 1 sample, but |
| toluene | 4.5 | 11.97 | 2 stripes lifted on |
| xylene | 4.5 | 11.97 | another sample. |
| pecan shell flour | 1.0 | 2.66 | |

EXAMPLE 6 (EG #10E)

| INGREDIENTS | WEIGHT (g) | CONCENTRATION (wt. %) | REMARKS |
|---|---|---|---|
| frit EG 4003 | 14.0 | 40.46 | Resistance |
| graphite | 3.6 | 10.40 | 180–290 Ω/in. |
| Electrodag 154 | 4.0 | 11.56 | Adherence good |
| acrylic lacquer | 3.0 | 8.67 | on 5 of 6 stripes, |
| toluene | 4.5 | 13.01 | part of 1 of 4 |
| xylene | 4.5 | 13.01 | stripe lifted on a |
| pecan shell flour | 1.0 | 2.89 | second sample. |

EXAMPLE 7 (EG #10H)

| INGREDIENTS | WEIGHT (g) | CONCENTRATION (wt. %) | REMARKS |
|---|---|---|---|
| frit EG 4003 | 14.0 | 37.23 | Resistance |
| graphite | 3.6 | 9.57 | 295–470 Ω/in. |
| Electrodag 154 | 4.0 | 10.64 | One sample looked |
| acrylic lacquer | 6.0 | 15.96 | good. Another |
| toluene | 3.0 | 7.98 | had some small |
| xylene | 3.0 | 7.98 | open circles at end |
| butyl cellosolve | 3.0 | 7.98 | of each stripe. |
| pecan shell flour | 1.0 | 2.66 | |

EXAMPLE 8 (EG #10I)

| INGREDIENTS | WEIGHT (g) | CONCENTRATION (wt. %) | REMARKS |
|---|---|---|---|
| frit EG 4003 | 14.0 | 36.75 | Resistance |
| graphite | 3.6 | 9.45 | 430–680 Ω/in. |
| Electrodag 154 | 4.0 | 10.50 | No lifting or |
| acrylic lacquer | 6.0 | 15.75 | blistering of |
| toluene | 3.0 | 7.87 | stripe on |
| xylene | 3.0 | 7.87 | sample. |
| butyl cellosolve | 3.0 | 7.87 | |
| pecan shell flour | 1.5 | 3.94 | |

EXAMPLE 9 (EG #10J)

| INGREDIENTS | WEIGHT (g) | CONCENTRATION (wt. %) | REMARKS |
|---|---|---|---|
| frit EG 4003 | 14.0 | 36.75 | Resistance |
| graphite | 3.6 | 19.45 | 475–650 Ω/in. |
| Electrodag 154 | 4.0 | 10.50 | No lifting |
| acrylic lacquer | 6.0 | 15.75 | or blistering |
| toluene | 4.5 | 11.81 | of stripe on |
| xylene | 4.5 | 11.81 | sample. |
| pecan shell flour | 1.5 | 3.93 | |

EXAMPLE 10 (EG #10K)

| INGREDIENTS | WEIGHT (g) | CONCENTRATION (wt. %) | REMARKS |
|---|---|---|---|
| frit EG 4003 | 14.0 | 36.75 | Resistance |
| graphite | 3.6 | 9.45 | 420–560 Ω/in. |
| Electrodag 154 | 4.0 | 10.50 | Salvage of |
| toluene | 7.5 | 19.69 | unbaked panel |
| xylene | 7.5 | 19.69 | a problem on |
| pecan shell flour | 1.5 | 3.93 | bare glass. |

EXAMPLE 11 (EG #10L)

| INGREDIENTS | WEIGHT (g) | CONCENTRATION (wt. %) | REMARKS |
|---|---|---|---|
| frit EG 4003 | 14.0 | 34.15 | Resistance |
| graphite | 4.5 | 10.98 | 570–650 Ω/in. |
| toluene | 11.5 | 28.05 | Unbaked coating |
| xylene | 9.5 | 23.17 | has no strength, |
| pecan shell flour | 1.5 | 3.65 | wipes off easily. |

EXAMPLE 12 (EG #10M)

| INGREDIENTS | WEIGHT (g) | CONCENTRATION (wt. %) | REMARKS |
|---|---|---|---|
| frit EG 4003 | 14.0 | 34.15 | Resistance |
| graphite | 4.5 | 10.98 | 390–600 Ω/in. |
| acrylic lacquer | 6.0 | 14.63 | Unbaked strength |
| toluene | 7.5 | 18.29 | fair, will |
| xylene | 7.5 | 18.29 | withstand some |
| pecan shell flour | 1.5 | 3.66 | handling. |

EXAMPLE 13 (EG #10N)

| INGREDIENTS | WEIGHT (g) | CONCENTRATION (wt. %) | REMARKS |
|---|---|---|---|
| frit EG 4003 | 14.0 | 32.94 | Resistance |
| graphite | 4.5 | 10.59 | 275–530 Ω/in. |
| acrylic alacquer | 6.0 | 14.11 | Unbaked strength |
| toluene | 9.0 | 21.18 | fair, about equal |
| xylene | 9.0 | 21.18 | to Example 12. |
| pecan shell flour | 1.0 | 2.89 | |

The faceplate panel used in Example 13 was salvaged and rerun using the above composition modified to evaluate Corning frit 8463. The modified composition is reported below as Example 14.

EXAMPLE 14 (EG #10N, MOD.1)

| INGREDIENTS | WEIGHT (g) | CONCENTRATION (wt. %) | REMARKS |
|---|---|---|---|
| frit 8463 | 14.0 | 32.94 | Resistance |
| graphite | 4.5 | 10.59 | 170–215 Ω/in. |
| acrylic lacquer | 6.0 | 14.11 | Stud test looks |
| toluene | 9.0 | 21.18 | good, but one |
| xylene | 9.0 | 21.18 | stud appears to |
| pecan shell flour | 1.0 | 2.89 | be contaminated. |

A second faceplate panel was prepared using the same formulation, including the Corning 8463 frit. The strength of the unbaked coating solution was fair and the electrical resistance of the unbaked coating was within the range of 185–260 Ω/in. The facplate panel was salvaged, prior to bake, and the dried coating solution was readily removed, except for a small amount of residue on the heavy, or thick, end of the stud stripe.

A blend of Ferro EG 4003 and Corning 8463 frit powders was also evaluated, as Example 15.

EXAMPLE 15 (BLEND "N")

| INGREDIENTS | WEIGHT (g) | CONCENTRATION (wt. %) | REMARKS |
|---|---|---|---|
| frit EG 4003 | 7.0 | 16.47 | Resistance |
| frit 8463 | 7.0 | 16.47 | 155–240 Ω/in. |
| graphite | 4.5 | 10.59 | Unbaked strength |
| acrylic lacquer | 6.0 | 14.11 | good, some edge |
| toluene | 9.0 | 21.18 | curl after bake. |
| xylene | 9.0 | 21.18 | |

It is believed that the edge curl on the stud stripes occurred because these areas were still wet when the faceplate was placed into the oven to bake-harden the conductive coating.

An additional test was performed on a SEM-COM Co. frit, identified as SCC-13-2. The formulation of that solution is listed in Example 16.

EXAMPLE 16 (SCC-13-2, as EG10N)

| INGREDIENTS | WEIGHT (g) | CONCENTRATION (wt. %) | REMARKS |
|---|---|---|---|
| frit SCC-13-2 | 14.0 | 36.36 | Resistance, |
| graphite | 4.5 | 11.69 | infinity. |
| acrylic lacquer | 6.0 | 15.59 | Unbaked strength, |
| toluene | 7.0 | 18.18 | very poor. |
| xylene | 7.0 | 18.18 | |

The SEM-COM frit is unsatisfactory for this application.

Additional tests were performed on larger quantities of solution, using Corning 8463 frit and different amounts of pecan shell flour. The results are listed below as Examples 17–19.

EXAMPLE 17 (Corning 8463)

| INGREDIENTS | WEIGHT (g) | CONCENTRATION (wt. %) | REMARKS |
|---|---|---|---|
| frit 8463 | 28.0 | 34.15 | Resistance |
| graphite | 9.0 | 10.98 | 245–310 Ω/in. |
| acrylic lacquer | 12.0 | 14.63 | Some peeling |
| toluene | 15.0 | 18.29 | of coating and |
| xylene | 9.0 | 18.29 | aluminum. |
| pecan shell flour | 3.0 | 3.66 | |

EXAMPLE 18 (Corning 8463)

| INGREDIENTS | WEIGHT (g) | CONCENTRATION (wt. %) | REMARKS |
|---|---|---|---|
| frit 8463 | 28.0 | 33.86 | Some indication |
| graphite | 9.0 | 10.88 | of peeling of the |
| acrylic lacquer | 12.0 | 14.51 | conductive |
| toluene | 15.0 | 18.14 | coating. |
| xylene | 9.0 | 18.14 | |
| pecan shell flour | 3.7 | 4.47 | |

EXAMPLE 19 (Corning 8463)

| INGREDIENTS | WEIGHT (g) | CONCENTRATION (wt. %) | REMARKS |
|---|---|---|---|
| frit 8463 | 28.0 | 33.10 | Some indication |
| graphite | 9.0 | 10.64 | of peeling of the |
| acrylic lacquer | 12.0 | 14.18 | conductive |
| toluene | 15.0 | 17.73 | coating. |
| xylene | 9.0 | 17.73 | |
| pecan shell flour | 5.6 | 6.62 | |

EXAMPLE 20 (Okuno DS 1406)

| INGREDIENTS | WEIGHT (g) | CONCENTRATION (wt. %) | REMARKS |
|---|---|---|---|
| frit DS 1406 | 5 | 46.51 | Adherence good. |
| TEOS | 2.5 | 23.26 | Resistance |
| Electrodag 154 | 2.0 | 18.60 | 100–200 Ω/in |
| graphite | 0.5 | 4.65 | |
| walnut shell flour | 0.75 | 6.98 | |

TEOS is tetraethyl orthosilicate. TEOS is an organic binder that binds the ingredients together before bakeout.

Two very large size (VLS) panels 12 were used to evaluate four formulations of the novel solution. Two separate formulations of Example 1 were utilized, each differed only in the amount of pecan shell flour in the solution. Examples 12 and 17 also were evaluated. The tests were conducted as follows: a first panel, panel #1, was aluminized and then each of the four formulations of the coating solutions was painted over the aluminum layer 24 and connected to a panel stud 27. The panel was then baked to harden and form the coating 38. The coatings 38, for Examples 1 and 12, looked good, had good adherence and showed no evidence of cracking or blistering. However, the 38 layer 24 also peeled. A second panel, panel #2, initially was prepared, with only a phosphor screen 22 and a matrix 23. The above-described four coatings (two formulations of Example 1, and Examples 12 and 17) were applied to the interior surfaces of three of the sidewalls 20 of the second panel 12. The second panel 12 was then spray filmed. After spray filming, the above-mentioned four coating formulations were applied to the then baked out. All of the coatings 38 looked good, with no cracking or blistering after spray filming. The coatings 38, formed by applying the four formulations after spray filming, but before aluminizing, also looked good and exhibited no cracks or blisters.

What is claimed is:

1. A bake-hardenable solution, that forms a conductive panel coating when hardened, for electrically interconnecting a metal stud embedded in a sidewall of a faceplate panel of a CRT to a conductive layer overlying a luminescent screen on an interior viewing surface of said faceplate panel, said solution consisting essentially of: glass frit powder; graphite; organic binder; solvent; and a material to enhance the porosity of the conductive panel coating, said material being selected from the group consisting of pecan shell flour and walnut shell flour.

2. The solution as described in claim 1, wherein said organic binder is selected from the group consisting of acrylic lacquer and TEOS.

3. The solution as described in claim 2, wherein said solvent is selected from the group consisting of butyl cellosolve, toluene and xylene.

4. The solution as described in claim 3, wherein the solvent comprises a mixture of butyl cellosolve, toluene and xylene.

5. The solution as described in claim 2, wherein the solvent comprises a mixture of toluene and xylene.

6. The solution as described in claim 2, wherein said solvent comprises xylene.

7. A bake-hardenable solution that is electrically conductive when hardened for electrically interconnecting a metal stud embedded in a sidewall of a faceplate panel of a CRT to a conductive layer overlying a luminescent screen on an interior viewing surface of said faceplate panel, said solution having a concentration consisting essentially of the following ingredients, in weight percent:

| | |
|---|---|
| glass frit powder | 34.15–46.51 |
| graphite powder | 10.98–18.60 |
| organic binder | 14.63–23.26 |
| solvent | 0–37.52 |
| porosity enhancer | 1.19–6.98 |

, wherein said porosity enhancer is selected from the group consisting of pecan shell flour and walnut shell flour.

8. The solution as described in claim 7, wherein said organic binder is selected from the group consisting of acrylic lacquer and TEOS.

9. The solution as described in claim 7, wherein said solvent is selected from the group consisting of toluene and xylene.

10. The solution as described in claim 9, wherein said solvent is a mixture of toluene and xylene.

11. The solution as described in claim 7, wherein said solvent comprises xylene.

12. A bake-hardenable solution that is electrically conductive when hardened for electrically interconnecting a metal stud embedded in a sidewall of a faceplate panel of a CRT to a conductive layer overlying a luminescent screen on an interior viewing surface of said faceplate panel, said solution having a concentration consisting essentially of the following ingredients, in weight percent:

| | |
|---|---|
| glass frit powder | 34.15–35.02 |
| graphite powder | 10.98–11.26 |
| acrylic lacquer | 14.63–15.01 |
| solvent | 36.58–37.52 |
| pecan shell flour | 1.19–3.66 |

13. The solution as described in claim 12, wherein said solvent is selected from the group consisting of toluene and xylene.

14. The solution as described in claim 13, wherein said solvent is a mixture of toluene and xylene.

15. The solution as described in claim 12, wherein said solvent comprises xylene.

* * * * *